US010458677B2

(12) United States Patent
Russell et al.

(10) Patent No.: US 10,458,677 B2
(45) Date of Patent: Oct. 29, 2019

(54) HEAT EXCHANGER WITH DUAL CONCENTRIC TUBE RINGS

(71) Applicant: Lochinvar, LLC, Lebanon, TN (US)

(72) Inventors: Jennifer Marie Russell, Brush Creek, TN (US); James Travis Adams, Lebanon, TN (US); David Clark Baese, Brentwood, TN (US); Barry Anthony Collins, Lebanon, TN (US)

(73) Assignee: Lochinvar, LLC, Lebanon, TN (US)

( * ) Notice: Subject to any disclaimer, the term of this patent is extended or adjusted under 35 U.S.C. 154(b) by 0 days.

(21) Appl. No.: 14/966,055

(22) Filed: Dec. 11, 2015

(65) Prior Publication Data

US 2017/0167753 A1 Jun. 15, 2017

(51) Int. Cl.

| | |
|---|---|
| ***F24H 1/40*** | (2006.01) |
| ***F24H 1/14*** | (2006.01) |
| ***F28D 7/16*** | (2006.01) |
| ***F28F 1/24*** | (2006.01) |

(52) U.S. Cl.

CPC ..... *F24H 1/403* (2013.01); *F24H 1/14* (2013.01); *F28D 7/1676* (2013.01); *F28F 1/24* (2013.01)

(58) Field of Classification Search

CPC ..... F24H 1/403
USPC ..... 122/235.14; 165/173
See application file for complete search history.

(56) References Cited

U.S. PATENT DOCUMENTS

| | | | | |
|---|---|---|---|---|
| 4,445,464 | A * | 5/1984 | Gerstmann | F24H 1/186 122/18.4 |
| 4,473,034 | A * | 9/1984 | Raudabaugh | F24H 1/403 122/18.4 |
| 4,721,068 | A * | 1/1988 | Bassols Rheinfelder | F24H 1/40 122/235.14 |
| 4,793,800 | A | 12/1988 | Vallett et al. | |
| 5,687,678 | A * | 11/1997 | Suchomel | F24H 1/43 122/247 |
| 6,428,312 | B1 | 8/2002 | Smelcer et al. | |
| 6,619,951 | B2 | 9/2003 | Bodnar et al. | |
| 6,694,926 | B2 | 2/2004 | Baese et al. | |
| 9,074,792 | B2 | 7/2015 | Ellingwood et al. | |
| 2005/0274328 | A1 | 12/2005 | Baese et al. | |
| 2006/0201662 | A1 | 9/2006 | Gilbert et al. | |

(Continued)

FOREIGN PATENT DOCUMENTS

| | | |
|---|---|---|
| EP | 1050721 A1 | 11/2000 |
| EP | 2072938 A2 | 6/2009 |
| GB | 2205150 A | 11/1988 |

OTHER PUBLICATIONS

International Search Report in corresponding International Application No. PCT/US16/57454 dated Jan. 6, 2017, 16 pp (not prior art).

(Continued)

*Primary Examiner* — Steven B McAllister
*Assistant Examiner* — John E Bargero
(74) *Attorney, Agent, or Firm* — Lucian Wayne Beavers; Patterson Intellectual Property Law, PC

(57) ABSTRACT

A water heater apparatus includes an elongated radial burner extending along a longitudinal central axis of the apparatus. First and second concentric rows of longitudinally extending fin tubes around the radial burner. The fin tubes may have multiple wiped circumferentially laterally portions allowing close packing of the fin tubes for improved efficiency and reduced footprint.

9 Claims, 10 Drawing Sheets

(56) References Cited

U.S. PATENT DOCUMENTS

| | | | | |
|---|---|---|---|---|
| 2007/0289723 | A1* | 12/2007 | Koster | B60H 1/00328 165/145 |
| 2008/0216772 | A1 | 9/2008 | Gordon et al. | |
| 2011/0203781 | A1 | 8/2011 | Ellingwood et al. | |
| 2015/0007779 | A1 | 1/2015 | Cui | |
| 2015/0300687 | A1* | 10/2015 | Cui | F24H 1/403 126/110 R |
| 2015/0323265 | A1* | 11/2015 | Hodsdon | F28D 7/1676 165/173 |

OTHER PUBLICATIONS

European Search Report of corresponding EP 16 87 3522 dated Jun. 24, 2019, 7 pages (not prior art).

* cited by examiner

HEAT EXCHANGER WITH DUAL CONCENTRIC TUBE RINGS

BACKGROUND OF THE INVENTION

1. Field of the Invention

The present disclosure relates generally to water heaters and boilers, and more particularly, but not by way of limitation, to an arrangement in construction of the fin tubes of a heat exchanger for a water heater.

2. Description of the Prior Art

One heat exchanger architecture which is found in the prior art includes an elongated radial burner concentrically received within a circular array of fin tubes. Such heat exchangers have previously been sold by the Assignee of the present invention under the Trademark POWER-FIN®. Examples of such heat exchangers are shown for example in U.S. Pat. No. 4,793,800 to Vallett et al., and U.S. Pat. No. 6,694,926 to Baese et al.

Elongated burners used in such heat exchangers may be constructed in accordance with the disclosures of Baese et al. U.S. Pat. No. 6,694,926; Bodnar et al., U.S. Pat. No. 6,619,951; and/or Smelcer et al., U.S. Pat. No. 6,428,312.

Additionally, it is known in the prior art to use an architecture similar to that described above but having two concentric rings of fin tubes surrounding the elongated burner. An example of a dual concentric ring fin tube architecture is seen in U.S. Pat. No. 9,074,792 to Ellingwood et al.

There is a continuing need in the construction of water heater apparatus to improve the operating efficiency and reduce the foot print or space occupied by the water heater.

SUMMARY OF THE INVENTION

A water heater apparatus is disclosed including an upper header having a water inlet and a water outlet, and including a lower header. An inner ring of inner fin tubes extends between the upper and lower headers and is communicated with the upper and lower headers to flow water through the inner fin tubes. Each inner fin tube includes a plurality of annual inner fin tube fins with circumferentially lateral portions of the inner fin tube fins bent to reduce a lateral cross-section dimension of the inner fin tube fins. An outer ring of outer fin tubes extends between the upper and lower headers and is located radially outward of the inner ring of inner fin tubes. The outer fin tubes are communicated with the upper and lower headers to flow water through the outer fin tubes. Each outer fin tube includes a plurality of annular outer fin tube fins with circumferentially lateral portions of the outer fin tube fins bent to reduce a lateral cross-section dimension of the outer fin tube fins. A burner tube is located radially inward of the inner ring of inner fin tubes and is configured to combust a fuel and air mixture and to radially project heated gases past the inner and outer rings of fin tubes to heat water flowing through the fin tubes.

In another embodiment, a water heater apparatus is disclosed including an elongated radial burner extending along a longitudinal center axis of the apparatus. A plurality of longitudinally extending fin tubes are provided. Each fin tube includes a plurality of fins having multiple wiped circumferentially lateral portions. The plurality of fin tubes are arranged to form a first ring concentrically disposed about the burner and a second ring concentrically disposed about the first ring. Each fin tube of a respective ring is arranged with one of the lateral portions thereof facing a corresponding lateral portion of an adjacent fin tube of the respective ring.

In any of the above embodiments the inner fin tubes may be close packed so that the bent circumferentially lateral portions of the inner fin tube fins of each inner fin tube contact the bent circumferentially lateral portions of the inner fin tube fins of each adjacent inner fin tube.

In any of the above embodiments the outer fin tubes may be close packed so that the bent circumferentially lateral portions of the outer fin tube fins of each outer fin tube contact the bent circumferentially lateral portions of the outer fin tube fins of each adjacent outer fin tube.

In any of the above embodiments at least some of the outer fin tubes made contact radially adjacent one of the inner fin tubes.

In any of the above embodiments the inner tube fin fins may each have a radially outer bent portion, at least some of the radially outer bent portions of the inner fin tube fins of at least some of the inner fin tubes contacting the outer fin tubes.

In any of the above embodiments the outer fin tube fins may each have two radially outer bent portions on either side of a radially outermost point of each outer fin tube fin, so that the outer fin tube fins of adjacent outer fin tubes define a V-shape space between their radially outermost points.

In any of the above embodiments a V-shaped baffle may be located in each of the V-shaped spaces.

In any of the above embodiments the bent circumferentially lateral portions of the fin tubes may be bent along lines extending substantially radially outwardly from a central axis of the apparatus.

A method of manufacturing a heat exchanger for a water heater is also disclosed, which method may include the steps of:

(a) providing a first plurality of fin tubes having laterally opposed wiped sides on each fin of the first plurality of fin tubes;

(b) providing a second plurality of fin tubes having laterally opposed wiped sides on each fin of the second plurality of fin tubes, the fins of the second plurality of fin tubes being wiped differently than the fins of the first plurality of fin tubes;

(c) assembling a first ring of the first plurality of fin tubes so that the laterally opposed wiped sides of adjacent fin tubes of the first plurality of fin tubes face each other; and (d) assembling a second ring of the second plurality of fin tubes, the second ring concentrically disposed about the first ring, so that the laterally opposed wiped sides of adjacent fin tubes of the second plurality of fin tubes face each other.

The method may further include in step (b) providing two radially outer wiped portions on either side of a radially outermost point of each of the fins of the second plurality of fin tubes, so that the fins of adjacent fin tubes of the second ring define a V-shaped space between their radially outermost points.

The method may further include a step of placing a V-shaped baffle in one of the V-shaped spaces.

The method may further include in step (a) providing a radially outer wiped side on each fin of the first plurality of fin tubes, and in steps (c) and (d) assembling the first and second rings such that at least some of the fin tubes of the second plurality of fin tubes touch the radially outer wiped sides of the fins of the first plurality of fin tubes.

The method may further include in step (c) the assembling of the first ring of the first plurality of fin tube so that the laterally opposed wiped sides of adjacent fin tubes of the first ring touch each other.

The method may further include in step (d) assembling the second ring of the second plurality of fin tubes so that the laterally opposed wiped sides of adjacent fin tubes of the second ring touch each other.

Numerous objects features and advantages of the present invention will be readily apparent of those skilled in the art upon a reading of the following disclosure when taken in conjunction with the accompanying drawings.

DETAILED DESCRIPTION

Figure 1:
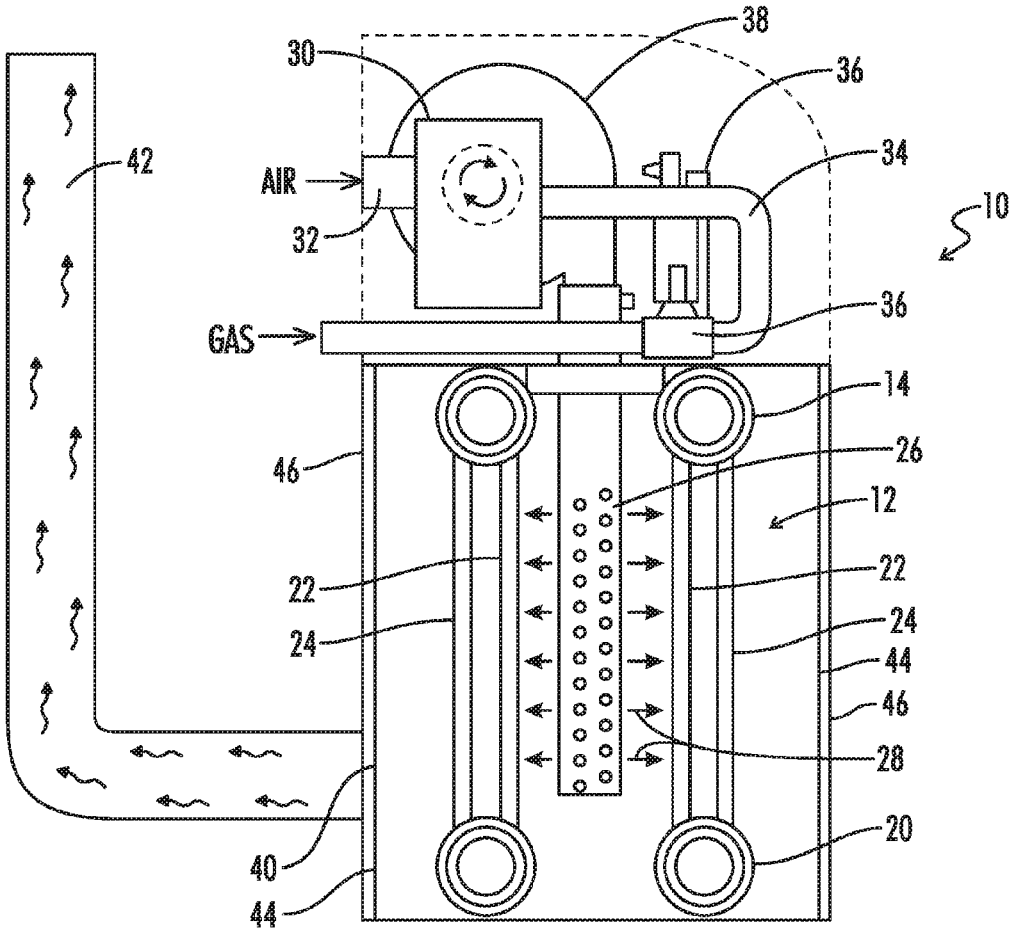
FIG. 1 is a schematic elevation view of a water heater apparatus.
Figure 2:
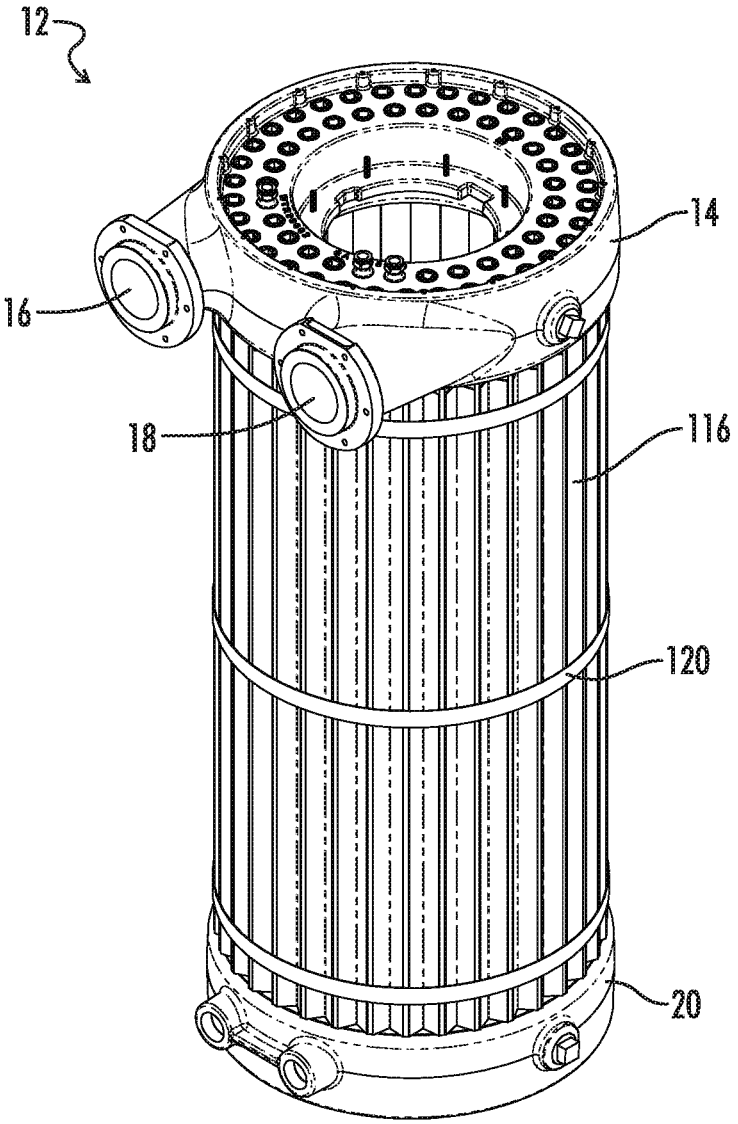
FIG. 2 is a perspective elevation view of the heat exchanger of the water heater apparatus of FIG. 1.
Figure 3:
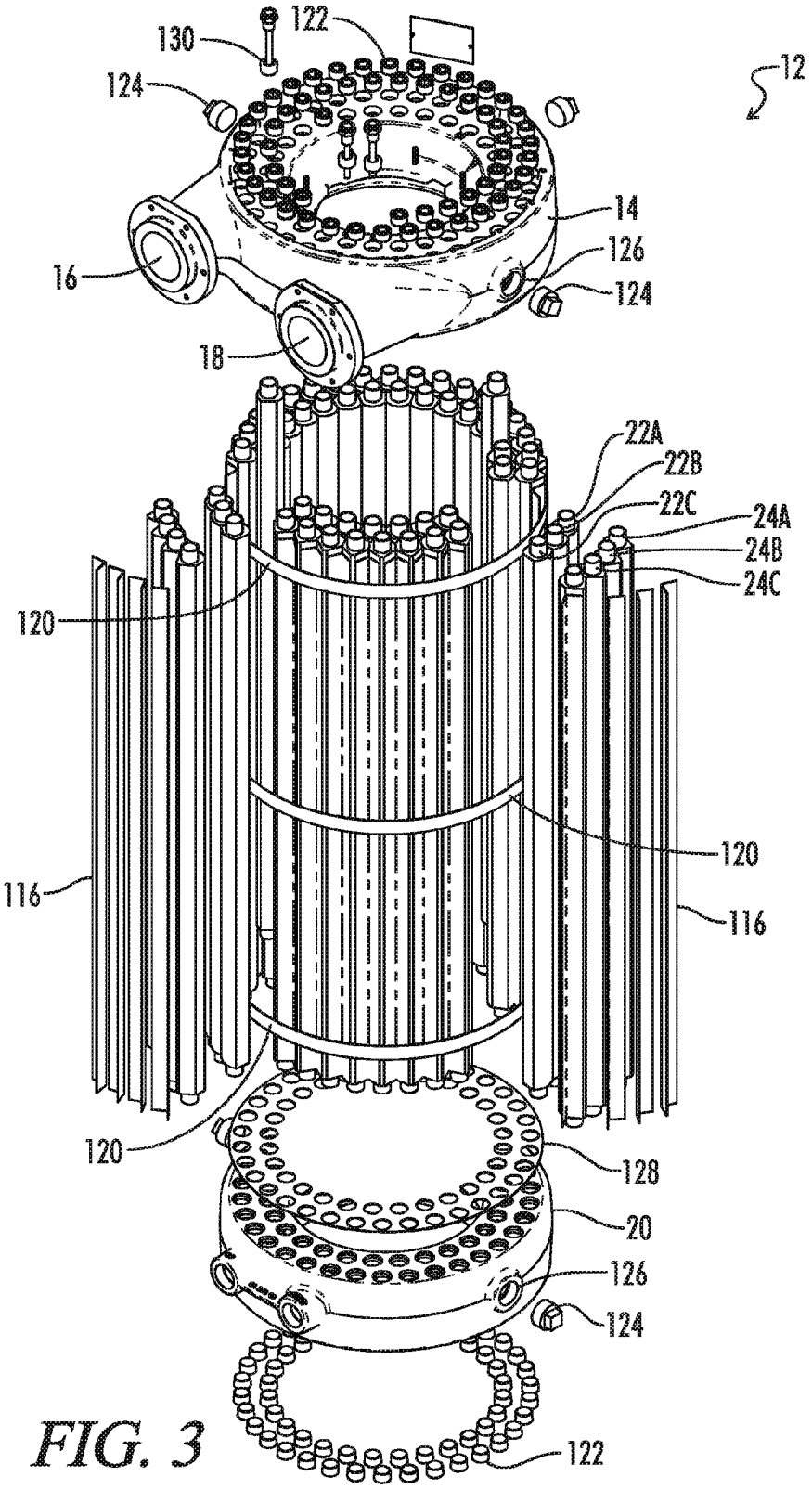
FIG. 3 is an exploded perspective view of the heat exchanger of FIG. 2.

Referring now to the drawings, and particularly to FIGS. 1-3, the water heater or boiler apparatus of the present invention is shown and generally designated by the numeral 10. As used herein, the term water heater refers to an apparatus for heating water, including both steam boilers and water heaters that do not actually "boil" the water. This discussion may refer to the apparatus 10 as a boiler 10, but it will be understood that this description is equally applicable to water heaters that do not boil the water. The water heater 10 includes a heat exchanger 12. The heat exchanger 12 includes an upper header 14 including a water inlet 16 and a water outlet 18. Heat exchanger 12 further includes a lower header 20.

An inner ring 22 of inner fin tubes 22A, 22B, 22C, etc., extends between the upper and lower headers 14 and 20. Inner fin tubes 22 are communicated with the upper and lower headers 14 and 20 to flow water through the inner fin tubes 22. An outer ring 24 of outer fin tubes 24A, 24B, 24C, etc., is located radially outward of the inner ring 22 and also extends between the upper and lower headers 14 and 20.

A burner tube or burner 26 is located radially inward of the inner ring 22 and is configured to combust a fuel and air mixture and radially project heated gasses as indicated by arrows 28 past the inner and outer rings 22 and 24 so as to heat water flowing through the fin tubes. The burner 26 may be constructed in any suitable manner including that disclosed in Baese et al. U.S. Pat. No. 6,694,926, or in U.S. Pat. No. 6,619,951 to Bodnar et al., or U.S. Pat. No. 6,428,312 to Smelcer et al., all of which are incorporated herein by reference. The burner 26 is of the type referred to as a pre-mix burner which burns a previously mixed mixture of combustion air and fuel gas. In the system shown in FIG. 1, a venturi 30 is provided for mixing combustion air and fuel gas. An air supply duct 32 provides combustion air to the venturi 30. A gas supply line 34 provides fuel gas to the venturi 30. The venturi 30, may, for example, be a model VMU680 provided by Honeywell. A gas control valve 36 is disposed in supply line 34 for regulating the amount of gas entering the venturi 30. The gas control valve 36 includes an integral shut-off valve.

In order to provide the variable output operation of the burner 26, a variable flow blower 38 delivers the pre-mixed combustion air and fuel gas to the burner 26 at a controlled burner flow rate within a burner flow rate range. The blower 38 may be driven by a variable frequency electric drive motor.

The gas line 34 may be connected to a conventional fuel gas supply (not shown) such as a municipal gas line, with appropriate pressure regulators and the like being utilized to control the pressure of the gas supplied to the venturi 30.

The gas control valve 36 is preferably a ratio gas valve for providing fuel gas to the venturi 30 at a variable gas rate which is proportional to the air flow rate entering the venturi 30, in order to maintain a predetermined air-to-fuel ratio over the flow rate range in which the blower 38 operates.

Combustion gases from the burner 26 exit the water heater 10 through a combustion gas outlet 40 which is connected to an exhaust gas flue 42.

The heat exchanger 12 may be contained within an internal liner 44, which may for example be made of stainless steel plate and be rectangular in cross-sectional plan. The exhaust gas flue 42 may be connected to the internal liner 44 and the combustion gas outlet 40 may be defined in the internal liner 44. The entire heat exchanger 12 and internal liner 44 may be enclosed within an outer housing 46.

Figure 4:
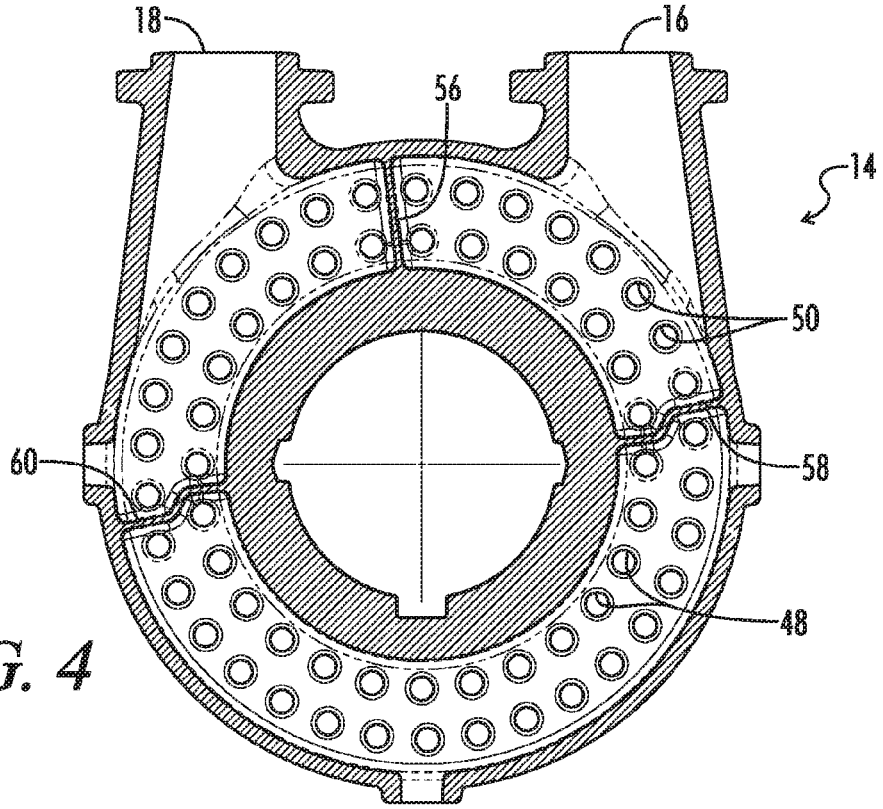
FIG. 4 is a cross-section plan view through the upper header of the heat exchanger of FIGS. 2 and 3.
Figure 5:
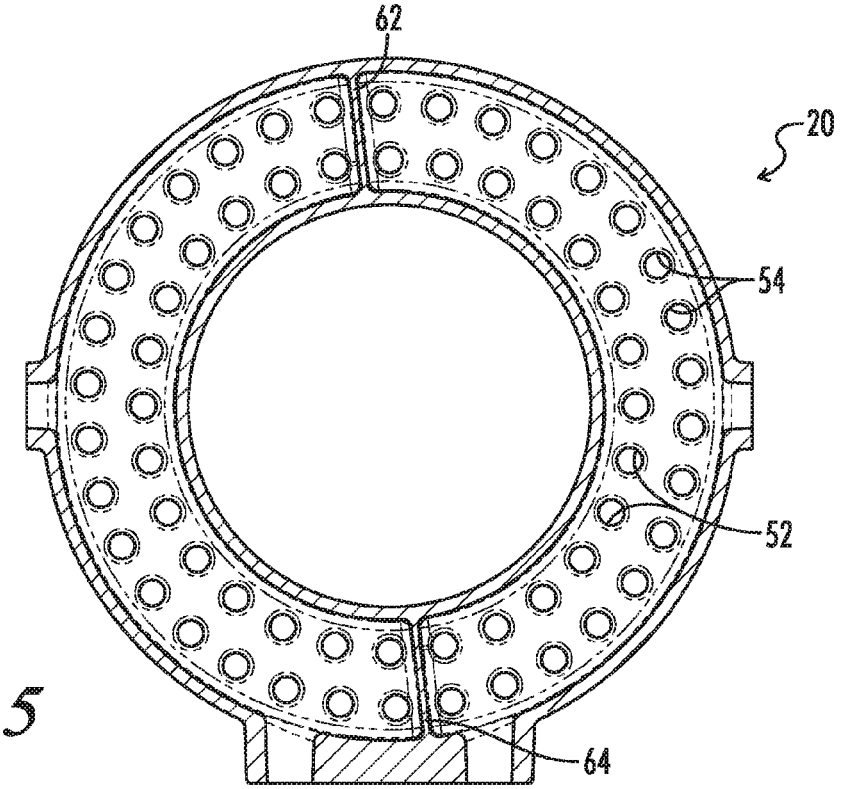
FIG. 5 is a cross-section plan view through the lower header of the heat exchanger of FIGS. 2 and 3.

FIGS. 4 and 5 show cross-section plan views of the upper and lower headers 14 and 20, respectively. It is noted that the upper header 14 includes an inner ring of upper header tube openings such as 48 and an outer ring of upper header tube openings such as 50. Similarly, the lower header 20 includes an inner ring of lower header tube openings 52 and an outer ring of lower header tube openings 54.

As is further described below, each of the fin tubes such as inner fin tube 22 is connected to the upper header via one of the inner ring upper header tube openings 48 and to the lower header via one of the inner ring lower header tube openings 52. Similarly, each of the outer tubes 24 is connected to the upper and lower headers via openings 50 and 54.

The upper header 14 includes first, second and third upper header baffles 56, 58 and 60. Lower header 20 includes first and second lower header baffles 62 and 64.

The arrangement of header baffles provides that the heat exchanger 12 operates in 4 passes. Thus in plan view a first quadrant of the heat exchanger 12 is defined between first and second upper header baffles 56 and 58, a second quadrant is defined between second upper header baffle 58 and second lower header baffle 64, a third quadrant is defined between second lower header baffle 64 and third upper header baffle 60, and the fourth quadrant is defined between third upper header baffle 60 and the first upper header baffle 56 and/or the first lower header baffle 62.

Thus water flowing into inlet 16 of the upper header 14 first flows downward through the tubes located in the first quadrant, then upward through the tubes located in the second quadrant, then downward through the tubes located in the third quadrant, then back upward through the tubes located in the fourth quadrant and out the water outlet 18 of upper header 14.

Construction of the Fin Tubes

Figure 8:
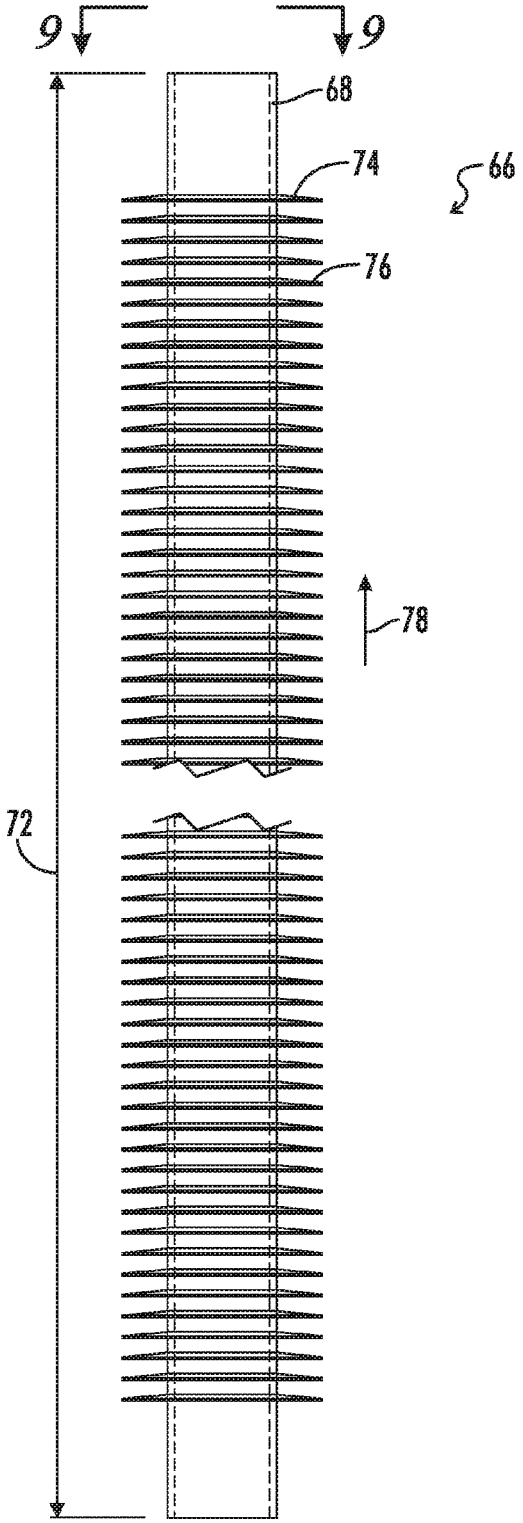
FIG. 8 is a schematic elevation view of a fin tube blank prior to bending of the fins to form one of the inner or outer fin tubes.
Figure 9:
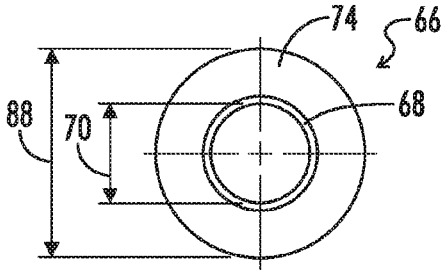
FIG. 9 is a plan view of the fin tube blank of FIG. 8 viewed along line 9-9 of FIG. 8.

Each of the inner fin tubes 22 and outer fin tubes 24 are manufactured from a fin tube blank such as the fin tube blank 66 shown if FIGS. 8 and 9. The fin tube blank 66 includes a central tube body 68 which is a length of cylindrical tubing of internal diameter 70 and length 72. A plurality of fins 74 are attached to and extend generally radially outward from central tube body 68. As seen in FIG. 9, the fins 74 initially are generally circular in shape and extend concentrically from the central tube body 68.

As best seen in FIG. 8, each of the fins 74 is initially slightly dished so that an upper surface 76 thereof slopes downward as seen in FIG. 8.

The inner fin tubes 22 and outer fin tubes 24 are each made from blanks like the fin tubes blank 66 shown in FIGS. 8 and 9, by a process known as wiping. In the wiping process, the fin tube blank 66 is pulled through a die having a shape corresponding to the desired final plan shape of the fins of the inner and outer fin tubes 22 and 24. The wiping will occur by pulling the fin tube blank 66 in a direction generally indicated by the arrow 78 through the die. As the fin tube blank 66 passes through the die, those portions of the fins engaging the edges of the die will be bent so that the fins 74 have a shape upon exiting the die generally corresponding to the internal shape of the die. Thus, referring for example to FIGS. 10 and 11 illustrating one of the inner fin tubes 22, a fin tube blank 66 as shown in FIGS. 8 and 9 is pulled through a die 80 having a shape generally as shown in FIG. 11A thus resulting in fins on the inner fin tube 22 having a shape generally as shown in FIG. 11.

Figure 13:
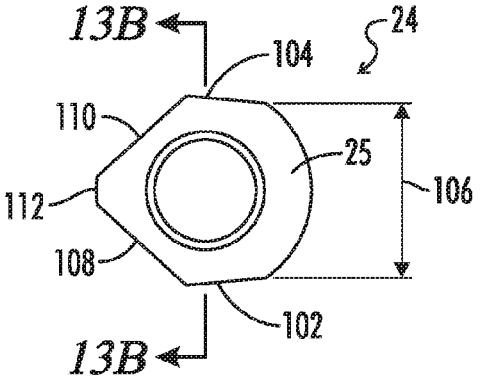
FIG. 13 is a plan view of the outer fin tube of FIG. 12 viewed along line 13-13 of FIG. 12.
Figure 13A:
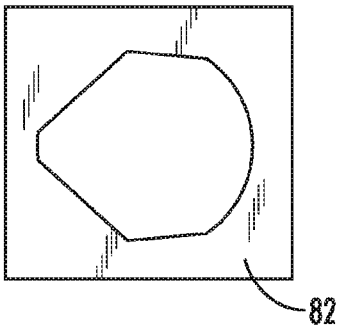
FIG. 13A is a plan view of a die used to form the outer fin tube of FIGS. 12 and 13.

Similarly, the outer fin tubes 24 may be formed by pulling a fin tube blank 66 through a die 82 having a shape generally as shown in FIG. 13A.

Figure 10:
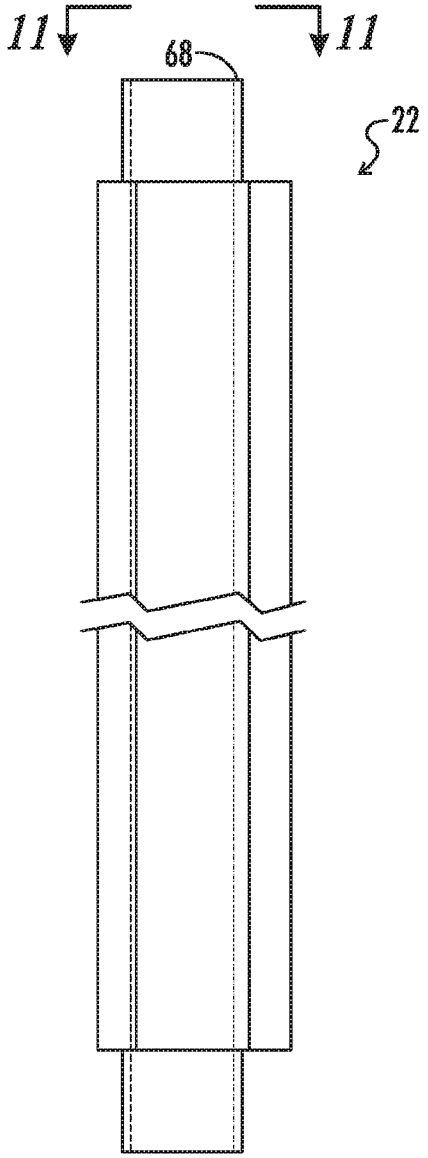
FIG. 10 is a schematic elevation view of one of the inner fin tubes forming the inner ring of fin tubes for the water heater apparatus of FIG. 2.
Figure 12:
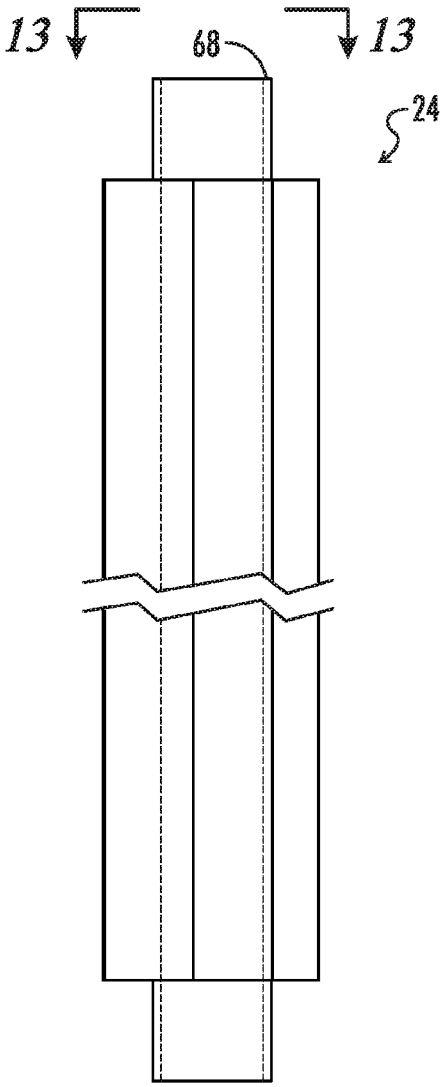
FIG. 12 is a schematic elevation view of one of the outer fin tubes forming the outer ring of fin tubes for the water heater apparatus of FIG. 2.
Figure 13B:
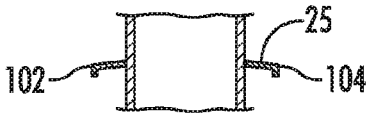
FIG. 13B is a cross-section view taken along line 13B-13B of FIG. 13 showing a schematic cross-section of one of the fins, and showing the bent or wiped sides of the fin.

It is noted that FIGS. 10 and 12 are both schematic, and do not attempt to show the individual fins like was done in FIG. 8. In FIGS. 10 and 12 only the general outer profiles of the collection of wiped fins 23 and 25, respectively are shown. Due to the folding of the fins, such as best shown in FIG. 13B, it will be understood that when viewed as in FIG. 10 or 12, the fins overlap vertically at the bent edges.

Figure 11:
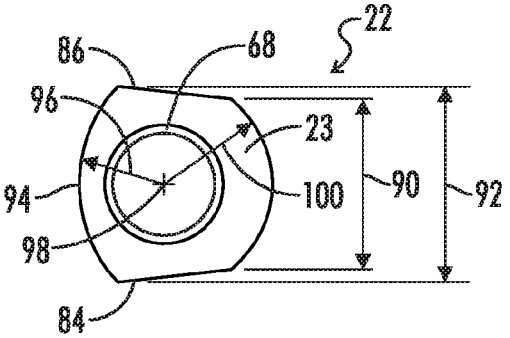
FIG. 11 is a plan view of the inner fin tube of FIG. 10 viewed along line 11-11 of FIG. 10.
Figure 11A:
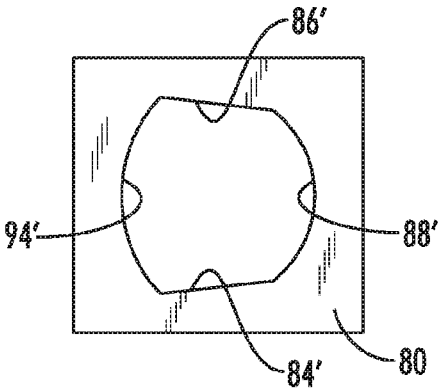
FIG. 11A is a plan view of a die used to form the inner fin tube of FIGS. 10 and 11.

Regarding inner fin tubes 22, as shown in FIG. 11, each of the fins 74 of the fin tube blank 66 has assumed a shape as indicated and as designated by the fins 23 of the inner fin tube 22. Similarly regarding outer fin tubes 24, as shown in FIG. 13, each of the fins 74 of the fin tube blank 66 has assumed the shape of the fins 25 of outer fin tubes 24.

As is best illustrated with reference to FIGS. 6, 7 and 11, each of the annular inner fin tube fins 23 of one of the inner fin tubes 22 has circumferentially lateral portions 84 and 86 bent to reduce a lateral cross-sectional dimension of the inner fin tube fins 23. Thus, with reference to FIG. 9, the fins 74 of the fin tube blank 66 started with a lateral cross-sectional dimension equal to the diameter 88 of the fins 74 as seen in FIG. 9. That diameter 88 has been reduced for the inner fin tubes 22 to a range between a narrowest circumferential cross-section dimension 90 to a largest circumferential cross section dimension 92, both of which are less than the initial diameter 88.

In the embodiment shown in FIG. 11, each of the inner fin tube fins 23 also has a radially outer bent portion 94 which has a reduced radius 96 from central axis 98 of tube body 68, as contrasted to the radially inner most unbent portion of fins 23 which have a radius equal to that of the original unbent fins 74 of the fin tube blank 66, namely one half of the original diameter 88.

Referring now to the die 80 which is used to form the bent fins 23 of inner fin tubes 22, the die 80 has internal surfaces 94' corresponding to bent surface 94, 84' corresponding to bent surface 84, 86' corresponding to bent surface 86, and 88' corresponding to unbent outer diameter.

It will be understood that due to the resilience of the fins 74 of the fin tube blank 66, the internal dimensions of surfaces 94', 84', 86' and 88' of the die 80 will be slightly smaller than the desired final dimensions of the corresponding surfaces of the fin 23 so that after the fins pass through the die and spring back slightly toward their initial shapes, the final dimensions of the fin 23 will be as needed for the final assembly of the heat exchanger 12.

Figure 6:
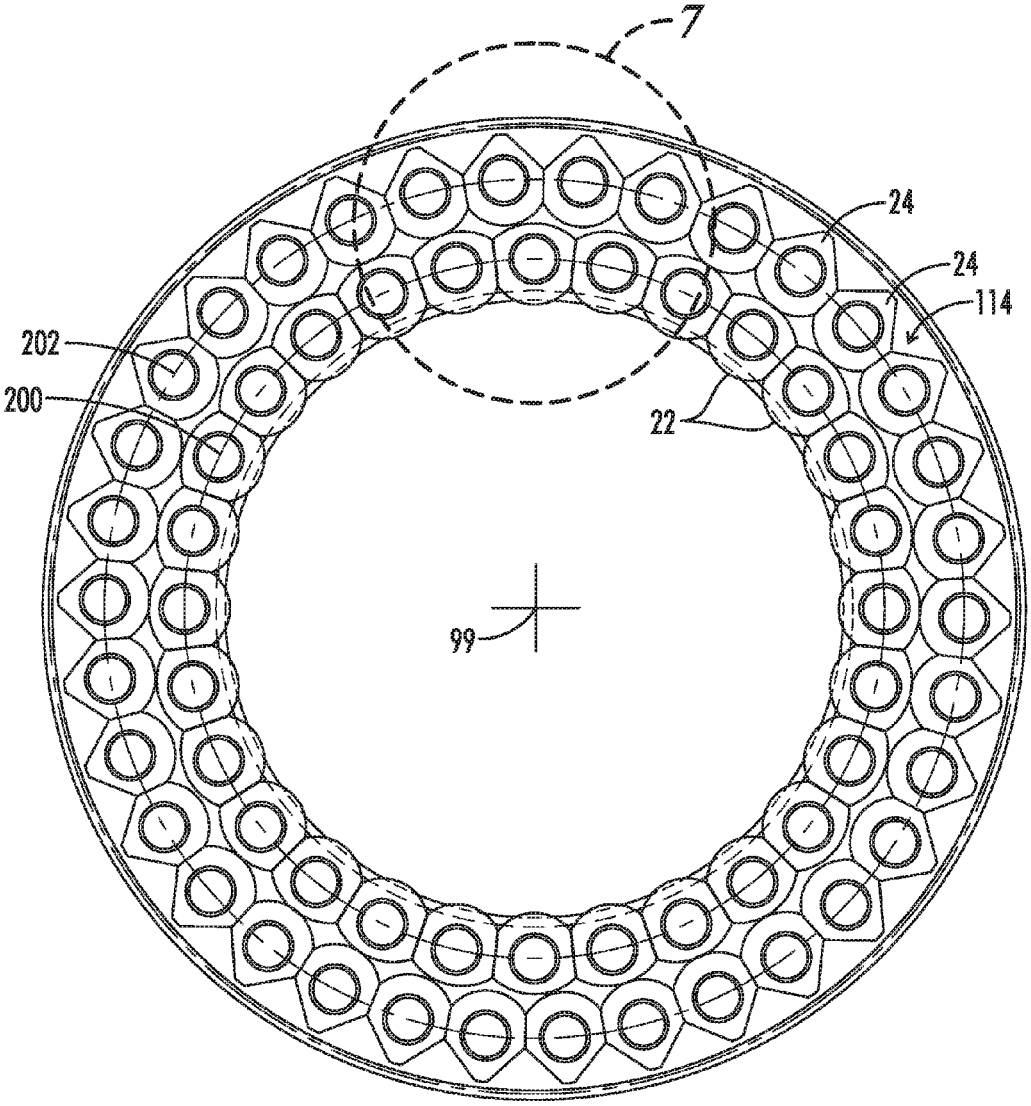
FIG. 6 is a schematic plan view showing the shape and arrangement of the fin tubes of the inner and outer concentric rings of fin tubes for the heat exchanger of FIG. 2.
Figure 7:
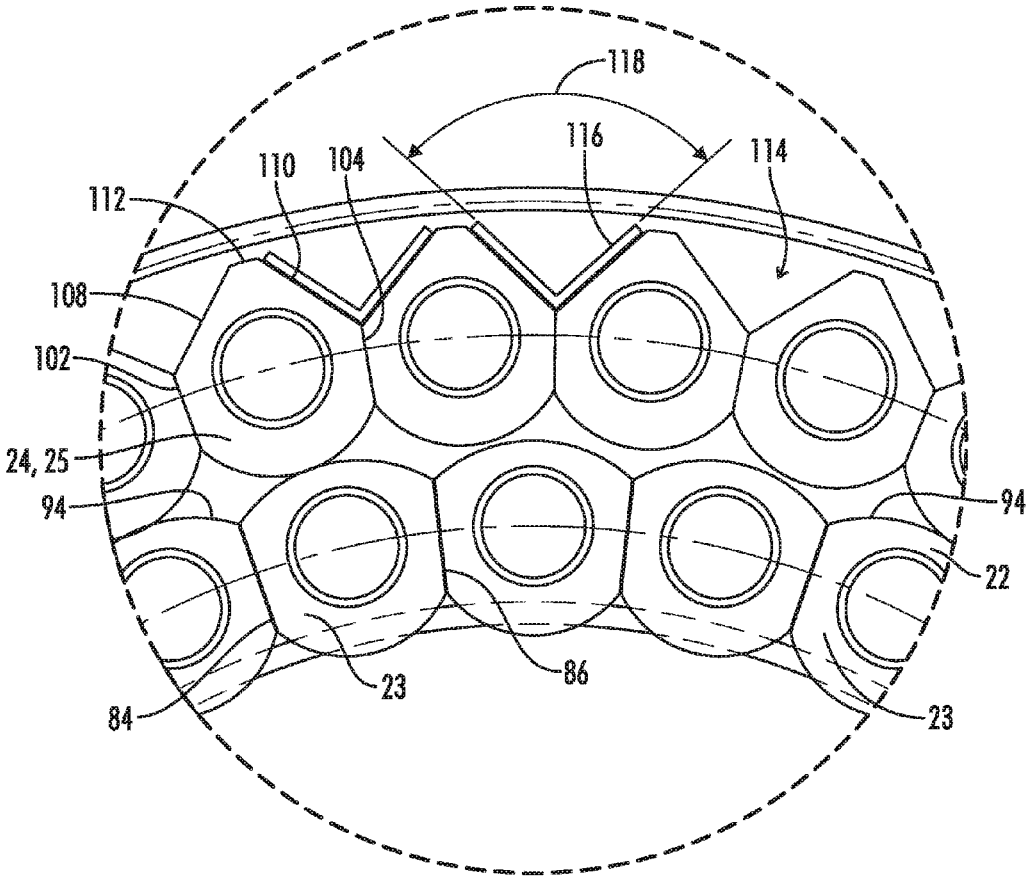
FIG. 7 is an enlarged view of the circled area identified as 7 in FIG. 6.

Referring now to FIGS. 6, 7, and 13, each of the fins 25 of each of the outer fin tubes 24 may have circumferentially lateral portions 102 and 104 bent to reduce a lateral cross section as indicated at 106 of the outer fin tube fins 25.

Each of the outer fin tube fins 25 may also have two radially outer bent portions 108 and 110 on either side of a radially outermost point 112 of each outer fin tube fin 25, so that the outer fin tube fins 25 of adjacent outer fin tubes 24 define a V-shaped space 114 there between as is best seen in FIGS. 6 and 7.

As seen in FIGS. 3 and 7, a V-shaped baffle 116 may be located in each of the V-shaped spaces 114.

The V-shaped baffles 116 as shown in plan view in FIG. 7 may comprise an angle 118 which may for example be in a range of from 80 degrees to 110 degrees, more preferably in a range from 90 degrees to 100 degrees, and most preferably about 95 degrees.

As is best appreciated in viewing FIGS. 6 and 7, the inner fin tubes 22 may be close packed so that the bent circumferentially lateral portions 84 and 86 thereof of the inner fin tube fins 23 of each inner fin tube 22 contact the bent circumferentially lateral portions 84 and 86 of the inner fin tube fins 23 of each adjacent inner fin tube 22. Similarly, the outer fin tubes 24 may be close packed so that the bent circumferentially lateral portions 102 and 104 of the outer fin tube fins 25 of each outer fin tube 24 contact the bent circumferentially lateral portions 102 and 104 of the outer fin tube fins 25 of each adjacent outer fin tube 24. Also, as seen in FIGS. 6 and 7, at least some of the outer fin tubes 24 may contact radially adjacent ones of the inner fin tubes 22.

More particularly, the outer fin tubes fins 25 may contact the radially outer bent portions 94 of the fins 23 of the inner fin tubes 22.

As is also apparent from FIGS. 6 and 7, each of the bent circumferentially lateral portions such as 84 and 86 of the inner fin tubes 22, and such as 102 and 104 of the outer fin tubes 24, are bent generally along lines extending substantially radially outward from a central axis 99 of the heat exchanger 12.

Methods of Manufacturing

The methods of manufacturing and assembling the heat exchanger 12 can best be appreciated with reference to FIGS. 3, 6 and 7.

As previously described, a plurality of the inner fin tubes 24 are constructed as described with regard to FIGS. 10 and 11 using the die of FIG. 11A, and a plurality of the outer fin tubes 24 are constructed as described with regard to FIGS. 12 and 13 using a die as shown in FIG. 13A.

Then as seen in FIGS. 3, 6 and 7, an inner ring or first ring of the inner fin tubes 22 may be assembled so that the laterally opposed wiped sides 84 and 86 of adjacent inner fin tubes 22 face each other to allow for close packing of the first ring 22. Preferably those wiped sides engage each other, although in some embodiments of the invention it is not required that the sides actually touch.

Similarly, the outer or second ring of fin tubes 24 is assembled so that laterally outer wiped sides 102 and 104 face each other, and preferably touch each other.

It will be appreciated that the positions of each of the inner fin tubes 22 and outer fin tubes 24 relative to each other is defined by the construction of the upper header 14 shown in FIG. 4 and the lower header 20 shown in FIG. 5. Particularly the tube locations are defined by the locations of the tube receiving holes 48 and 50 of upper header 14 and 52 and 54 of lower header 20.

It will be appreciated that the central tube body 68 of each of the fin tubes 22 or 24 is received in the openings in the upper and lower headers. In the construction illustrated, the central tube bodies 68 are received in the openings 48, 50, 52, 54 as appropriate, and then are swaged or otherwise formed so as to hold the central tube bodies 68 firmly in place within the headers 14 and 16. This is a form of construction sometimes referred to as a gasketless header. It is noted that with this construction the heat exchanger 12 does not include tube sheets to hold the array of tubes in place.

As best seen in FIG. 3, after the inner and outer rows 22 and 24 of fin tubes are assembled with the upper and lower headers 14 and 16, the V-shaped baffles 116 may be put in place, and then three circumferentially extending baffle retainers or bands 120 may be placed around the V-shaped baffles 116 to hold them in place.

As seen in FIG. 3, the heat exchanger 12 may also include brass plugs 122 which close the outer openings in the headers corresponding to the position of the various fin tubes. Brass plugs 122 may be removed to allow cleaning of the bores of the central tube bodies 68. Brass plugs 124 may be provided to plug various access ports such as 126 in the headers. A tube template 128 may be provided to aid in placement of the tubes during assembly. One or more bulbwells 130 may be provided to aid in connecting various temperature sensors or the like to the headers.

FIG. 13B is a schematic cross-section view taken along line 13B-13B of FIG. 13 to show how the fin 25 is folded or bent at bent portions 102 and 104 during the wiping process. It will be understood that FIG. 13B is schematic only and not to scale and shows only a single one of the fins 25 and exaggerates the bent portions thereof. The other wiped, folded or bent portions or edges such as 108 and 110 of fins 25 and such as 84, 86 and 94 of fins 23 are similarly bent or folded when seen in cross-section view.

The wiping of tubes so that they may be arranged in a close packed manner as illustrated results in both a smaller footprint for the assembled water heater, and a higher efficiency of the water heater due to the improved flow pattern of gases through the fins.

Figure 14:
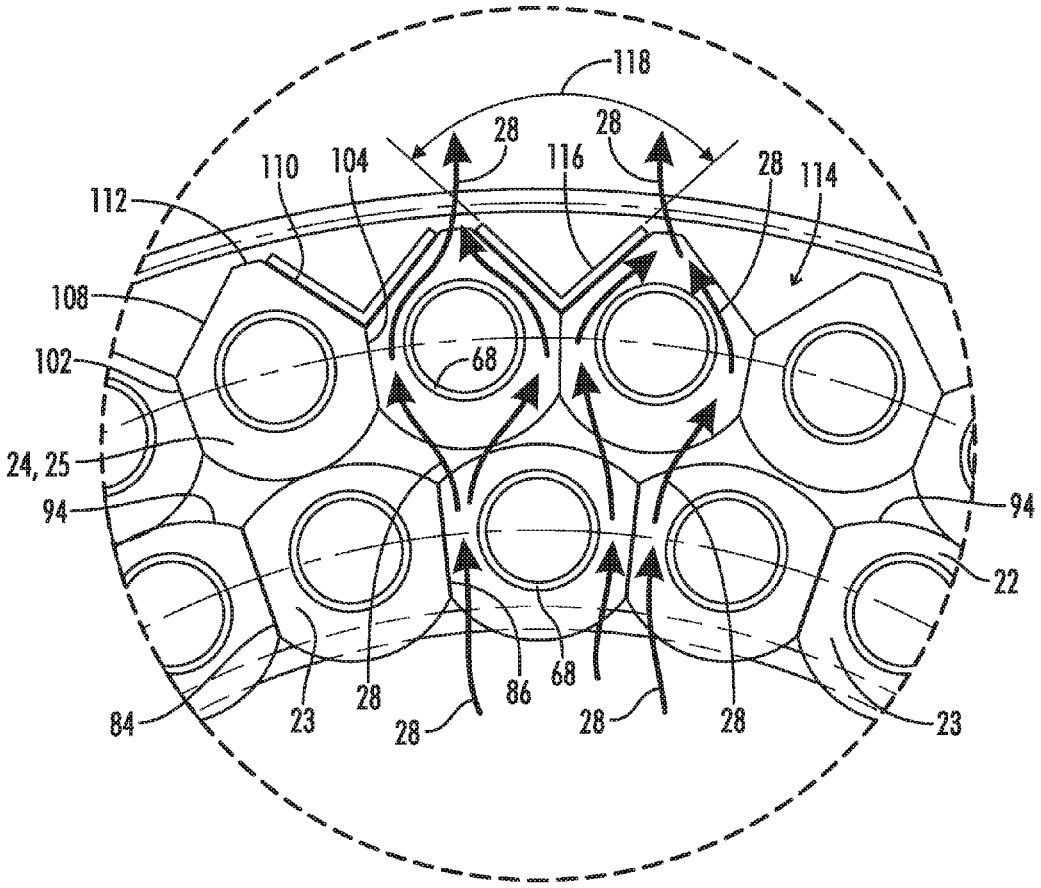
FIG. 14 is a view similar to FIG. 7 schematically illustrating with arrows the flow path of hot gases flowing radially outward past the inner and outer rings of fin tubes.

FIG. 14 is a view similar to FIG. 7 to which has been added schematic representations of the various gas flow paths of the hot combustion gases as they flow radially outward past the fin tubes. Thus the gases represented by the arrows 28 in FIG. 1 will typically follow paths such as indicated by the arrows 28 in FIG. 14. As will be appreciated, the gases will typically flow between each of the folded sides 84 and 86 and the associated central tube bodies 68 as they flow radially outward past the inner fin tubes 22. Then the gases will flow between each of the folded sides 102 and 104 of the outer fin tubes 24 and their associated central tube bodies 68 and then through the small gaps between adjacent V-shaped baffles 116 to exit the outer ring of fin tubes 25.

Thus the wiping of the tube fins generally causes the gas flow to closely adhere to the central tube bodies 68 thus enhancing heat transfer from the hot combustion gases 28 to the water flowing through the central tube bodies 68.

Example

With reference to FIG. 6, one example of an arrangement of fin tubes 22 and 24 to construct a heat exchanger 12 in accordance with the present disclosure includes a total of twenty-eight inner fin tubes 22 and thirty-four outer fin tubes 24. Thus, a total of 62 fin tubes are provided. In this embodiment, each of the fin tubes may have a central tube body 68 having a nominal inside diameter of approximately 0.88 inch and having fins with a nominal outside diameter prior to wiping of 1.86 inch. The tubes may have an overall length of the finned area of between 39 and 40 inches. Both the central tube bodies 66 and the fins are preferably made of copper.

The central axes of the central tube bodies of the inner fin tubes 22 may be placed upon a diameter 200 of approximately 14.25 inches, and the axes of the outer fin tubes 24 may be placed on a diameter 202 of approximately 17.5 inches about the central axis 99 of heat exchanger 12. With this arrangement each of the inner fin tubes 22 subtend an angle of approximately 12.9 degrees about the central axis 99, and each of the outer fin tubes 24 subtend an angle of approximately 10.6 degrees about the central axis 99.

Such an arrangement may provide a water heater apparatus 10 having a nominal output of 3.5 MBtu per hour. With this arrangement operating efficiencies as high as 87% may be achieved. Other arrangements may be used to provide nominal outputs ranging for example from 2.5 MBtu per hour to 5.0 MBtu per hour.

Thus it is seen that the apparatus and methods of the present invention readily achieve the ends and advantages mentioned, as well as those inherent therein. While certain preferred embodiments of the invention have been described for purposes of the present disclosure, numerous changes in the arrangement and construction of parts and steps may be made by those skilled in the art, which changes are encompassed within the scope and spirit of the present invention as defined by the appended claims.

What is claimed is:

1. A water heater apparatus, comprising:

an upper header including a water inlet and a water outlet;

a lower header;

an inner ring of inner fin tubes concentrically disposed about a longitudinal central axis of the inner ring and extending between the upper and lower headers and communicated with the upper and lower headers to flow water through the inner fin tubes, each inner fin tube including a plurality of annular inner fin tube fins with circumferentially lateral portions of the inner fin tube fins bent along lines extending substantially radially outward from the central axis of the inner ring to reduce a lateral cross-section dimension of the inner fin tube fins, the inner fin tubes being close packed so that the bent circumferentially lateral portions of the inner fin tube fins of each inner fin tube contact the bent circumferentially lateral portions of the inner fin tube fins of each adjacent inner fin tube;

an outer ring of outer fin tubes concentrically disposed about the longitudinal central axis of the inner ring and extending between the upper and lower headers and located radially outward of the inner ring of inner fin tubes and communicated with the upper and lower headers to flow water through the outer fin tubes, each outer fin tube including a plurality of annular outer fin tube fins with circumferentially lateral portions of the outer fin tube fins bent along lines extending substantially radially outward from the central axis of the inner ring to reduce a lateral cross-section dimension of the outer fin tube fins, there being a larger number of outer fin tubes than inner fin tubes, the outer fin tubes being close packed so that the bent circumferentially lateral portions of the outer fin tube fins of each outer fin tube contact the bent circumferentially lateral portions of the outer fin tube fins of each adjacent outer fin tube; and a burner tube located radially inward of the inner ring of inner fin tubes and configured to combust a fuel and air mixture and radially project heated gases past the inner and outer rings of fin tubes to heat water flowing through the fin tubes; and wherein the inner fin tube fins each have a radially outer bent portion, the radially outer bent portion being located on a radially outer portion of each inner fin tube fin relative to the longitudinal central axis of the inner ring, at least some of the radially outer bent portions of the inner fin tube fins of at least some of the inner fin tubes contacting the outer fin tubes.

2. The apparatus of claim 1, wherein:

the outer fin tube fins each have two radially outer bent portions on either side of a radially outermost point, relative to the longitudinal central axis of the inner ring, of each outer fin tube fin, so that the outer fin tube fins of adjacent outer fin tubes define a V-shape space between their radially outermost points.

3. The apparatus of claim 2, further comprising:

a plurality of V-shape baffles, each baffle located in one of the V-shape spaces.

4. A water heater apparatus, comprising:

an elongated radial burner extending along a longitudinal central axis of the apparatus; and a plurality of longitudinally extending fin tubes, each fin tube including a plurality of fins having multiple wiped circumferentially lateral portions, the plurality of fin tubes arranged to form a first ring concentrically disposed about the burner and a second ring concentrically disposed about the first ring, there being a larger number of fin tubes in the second ring than in the first ring, each fin tube of a respective ring arranged with one of the lateral portions facing a corresponding lateral portion of an adjacent fin tube of the respective ring; and wherein at least some of the fin tubes of the first ring engage an adjacent fin tube of the first ring;

wherein each of the fins of the fin tubes of the first ring includes a wiped radially outer portion, the wiped radially outer portion being defined relative to the longitudinal central axis of the apparatus;

wherein at least some of the fin tubes of the second ring engage an adjacent fin tube of the second ring;

wherein at least some of the fin tubes of the second ring engage the wiped radially outer portion of at least some of the fin tubes of the first ring; and wherein each of the wiped circumferentially lateral portions of the fins is substantially parallel to a line extending radially outward from the longitudinal central axis of the apparatus.

5. The apparatus of claim 4, wherein:

each of the fins of the fin tubes of the second ring have two radially outer wiped portions on either side of a radially outermost point of each of the fins, relative to the longitudinal central axis of the apparatus, so that the fins of adjacent fin tubes of the second ring define a V-shape space between their radially outermost points.

6. The apparatus of claim 5, further comprising:

a plurality of V-shape baffles, each baffle located in one of the V-shape spaces.

7. A method of manufacturing a heat exchanger for a water heater, comprising;

(a) providing a first plurality of fin tubes having laterally opposed wiped sides and a radially outer wiped side on each fin of the first plurality of fin tubes;

(b) providing a second plurality of fin tubes having laterally opposed wiped sides on each fin of the second plurality of fin tubes, the fins of the second plurality of fin tubes being wiped differently than the fins of the first plurality of fin tubes, the second plurality of fin tubes being greater in number than the first plurality of fin tubes;

(c) assembling a first ring of the first plurality of fin tubes concentrically about a longitudinal central axis of the first ring so that the laterally opposed wiped sides of at least some adjacent fin tubes of the first plurality of fin tubes touch each other, the radially outer wiped sides of the fins of the first plurality of fin tubes being located on a radially outer portion of each fin relative to the longitudinal central axis of the first ring; and (d) assembling a second ring of the second plurality of fin tubes, the second ring concentrically disposed about the first ring, so that the laterally opposed wiped sides of adjacent fin tubes of the second plurality of fin tubes face each other, and so that at least some of the fin tubes of the second plurality of fin tubes touch the radially outer wiped sides of the fins of the first plurality of fin tubes.

8. The method of claim 7, wherein:

step (b) further comprises providing two radially outer wiped portions on either side of a radially outermost point, relative to the longitudinal central axis of the first ring, of each of the fins of the second plurality of fin tubes, so that the fins of adjacent fin tubes of the second ring define a V-shape space between their radially outermost points.

9. The method of claim 8, further comprising:

placing a V-shape baffle in one of the V-shape spaces.

* * * * *